US005918434A

United States Patent [19]

Ballantyne et al.

[11] Patent Number: 5,918,434

[45] Date of Patent: Jul. 6, 1999

[54] SIMULATED PANEL DOOR STRUCTURE AND METHOD

[75] Inventors: Mark Ballantyne; Grant T. Bennett; Douglas R. Smith, all of Sacramento, Calif.

[73] Assignee: American Building Supply, Inc., Sacramento, Calif.

[21] Appl. No.: 08/870,765

[22] Filed: Jun. 6, 1997

[51] Int. Cl.[6] ..... E04F 13/00; E04F 15/00; E04F 19/00

[52] U.S. Cl. ..... 52/311.1; 52/312; 52/313; 52/314; 52/316; 52/455; 52/456

[58] Field of Search ..... 52/311.1, 312, 52/313, 314, 316, 455, 456

[56] References Cited

U.S. PATENT DOCUMENTS

| | | | |
|---|---|---|---|
| 3,731,444 | 5/1973 | Tobin . | |
| 4,008,551 | 2/1977 | MacDonald et al. . | |
| 4,083,160 | 4/1978 | MacDonald et al. . | |
| 4,704,834 | 11/1987 | Turner . | |
| 4,706,431 | 11/1987 | MacDonald et al. . | |
| 4,756,350 | 7/1988 | Turner . | |
| 5,022,206 | 6/1991 | Schield et al. | 52/313 X |
| 5,095,675 | 3/1992 | Audia . | |
| 5,325,648 | 7/1994 | Menard | 52/455 X |
| 5,560,168 | 10/1996 | Gagne et al. | 52/455 |

*Primary Examiner*—Carl D. Friedman
*Assistant Examiner*—W. Glenn Edwards
*Attorney, Agent, or Firm*—Theodore J. Bielen, Jr.

[57] ABSTRACT

A simulated panel door structure formed from a flat surface door utilizing an endless groove formed along the flat surface and etched to a uniform depth. The endless groove possesses a base surface and first and second side walls extending outwardly from the base surface. The second side wall of the groove is positioned outside the first side wall toward the periphery of the door. An insert having a lower surface and first and second side walls positions within the endless groove such that the lower surface of the insert lies adjacent the base surface of the groove. The first side wall of the insert lies adjacent a beveled surface of the veneer and extends no further outwardly than the flat surface of the door. The second side wall of the insert lies adjacent the second side wall of the groove. The insert further includes a lateral surface spanning the first and second side walls with a depression therealong.

8 Claims, 2 Drawing Sheets

SIMULATED PANEL DOOR STRUCTURE AND METHOD

BACKGROUND OF THE INVENTION

The present invention relates to a novel raised panel door structure and process for producing the same.

Doors which divide rooms and enclose spaces such as closets are often decorated in many ways. In the past, decorative pieces have been applied directly to the flat surface of the door in order to provide aesthetic appeal. Also, such trim pieces have been placed within a routed or grooved panel to afford better support.

Further, skilled artisans have directly carved designs into doors, although this appears to be a lost art. Needless to say, carving doors is a very expensive and time consuming labor at the present period.

Most doors which are presently manufactured for use in edifices include a solid core of material such as plywood chipboard, and the like, using phenolic or urea type glues. A veneer is attached to the core to provide the appearance of a solid structure, i.e. a solid wood door. Unfortunately, such veneer constructions do not readily permit relief designs, since they are generally formed with a flat or smooth outer surface.

U.S. Pat. Nos. 4,704,834 and 4,756,350 depict a method of making raised panel doors from veneer core doors. These patents include the forming of a groove in the door and the placing of an inlay within the groove, as well as a central panel and surrounding trim.

U.S. Pat. Nos. 3,731,444, 4,008,551, and 4,083,160 show raised panel door manufacturing systems in which grooves are cut into a veneer and filled with a trim which lies in a depression of the groove.

U.S. Pat. Nos. 4,706,431 and 5,095,675 build a panel door from a veneer-core door by the application of a groove and the placing of a trim piece overlapping the outer veneer surface of the door.

A system for producing a simulated panel door which includes a smooth transition between the veneer of the door and the molding surrounding the panel portion would be a notable advance in the wood working arts.

SUMMARY OF THE INVENTION

In accordance with the present invention a novel and useful simulated panel door structure is herein provided.

The structure of the present invention is used in conjunction with a door having a solid core and a veneer top possessing a flat surface. The veneer may take the form of natural wood, plastic material, or other thin sheets of material that present an acceptable surface appearance. Endless grooves are formed along the flat surface of the door and into the core of the door. The endless groove possesses an essentially uniform depth, a base surface, and first and second side wall portions that extend outwardly from the base surface. The first side wall is generally located toward the periphery of the door while the second side wall is positioned toward the center of the door.

The present invention also includes an insert which is fitted within the formed groove of the door. The insert possesses a lower surface, and first and second side walls that extend outwardly from the lower surface. When placed in the groove, the insert lower surface lies adjacent the base surface of the groove, while the first and second side walls of the insert lie adjacent the first and second side walls of the groove, respectively. The first side wall of the groove extends no further outwardly, and at a place, below the flat surface of the door. Specifically, the edge of the first side wall lies adjacent the veneer which is beveled such that there is meeting or abutment of the upper edge of the wall of the insert and the lower edge of the bevel of the veneer. The second wall of the insert may either lie adjacent the veneer or overlap the veneer toward the periphery of the door. Such overlap may be accomplished for decorative purposes or to gain further support from the top surface of the panel door. The insert may be fastened to the groove of the panel door via any suitable fastening means such as mastic, fasteners, and the like.

It may be apparent a novel and useful simulated panel door structure and method has been herein above described.

It is therefore an object of the present invention to provide a simulated panel door structure which is simple to manufacture from a standard veneer door.

Another object of the present invention is to provide a simulated panel door structure which emulates a raised panel door having a hip raised style.

A further object of the present invention is to provide a simulated raised panel door and a method of producing the same which includes routing or grooving the panel structure of the panel door without affecting the strength of the door for use thereafter.

Yet another object of the present invention is to provide a simulated panel door which is relatively inexpensive to manufacture.

The invention possesses other objects and advantages especially as concerns particular characteristics and features thereof which will become apparent as the specification continues.

For a better understanding of the invention references made to the following detailed description of the preferred embodiments are of which are to be referenced to the prior described drawings.

DETAILED DESCRIPTION OF THE PREFERRED EMBODIMENTS

Various aspects of the present invention will evolve from the following detailed description of the preferred embodiments, thereof, which should be taken in conjunction with the hereinabove described drawings.

Figure 1:
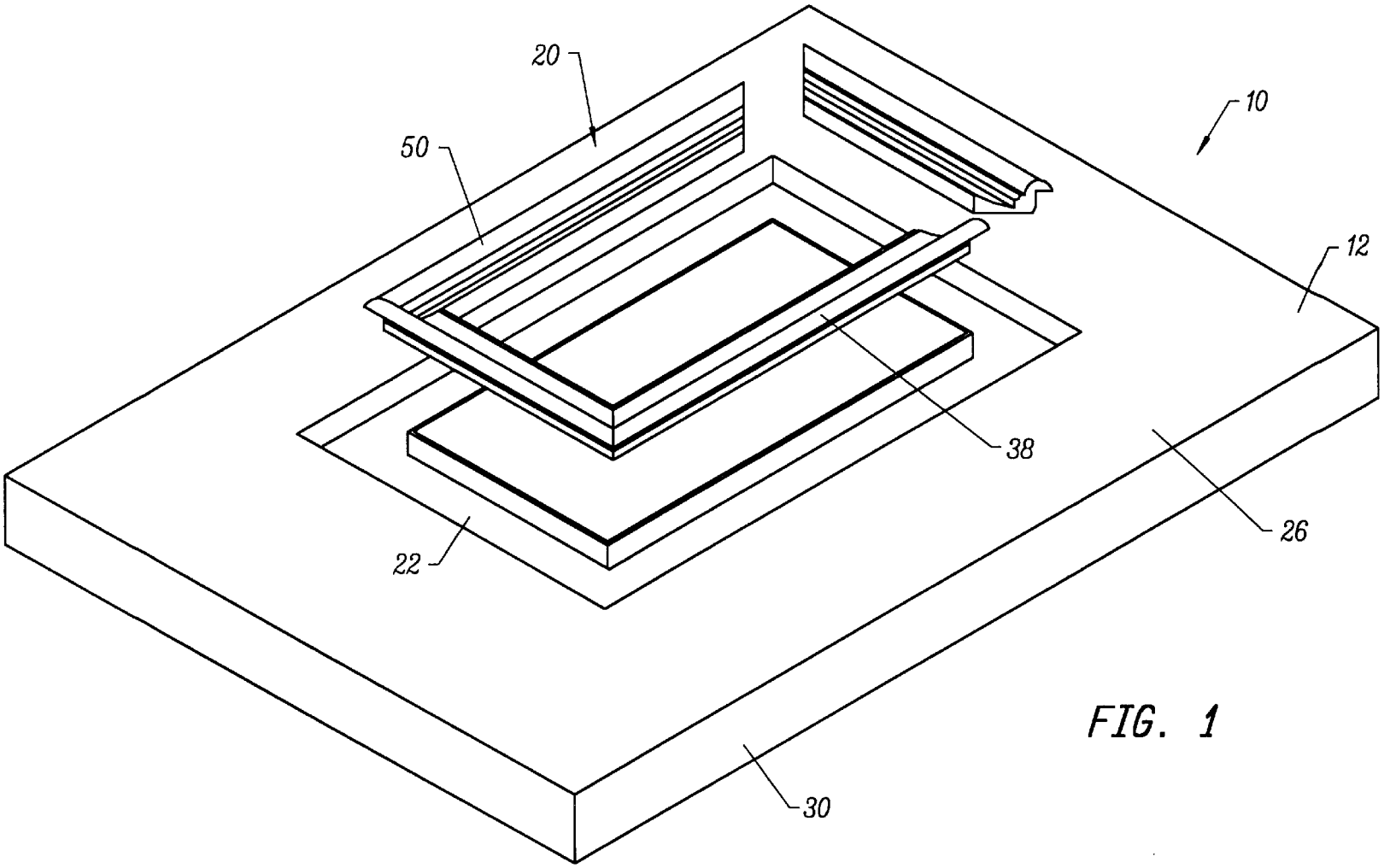
FIG. 1 is a top perspective view of the simulated panel door of the present invention showing the insert pieces in exploded configuration.
Figure 2:
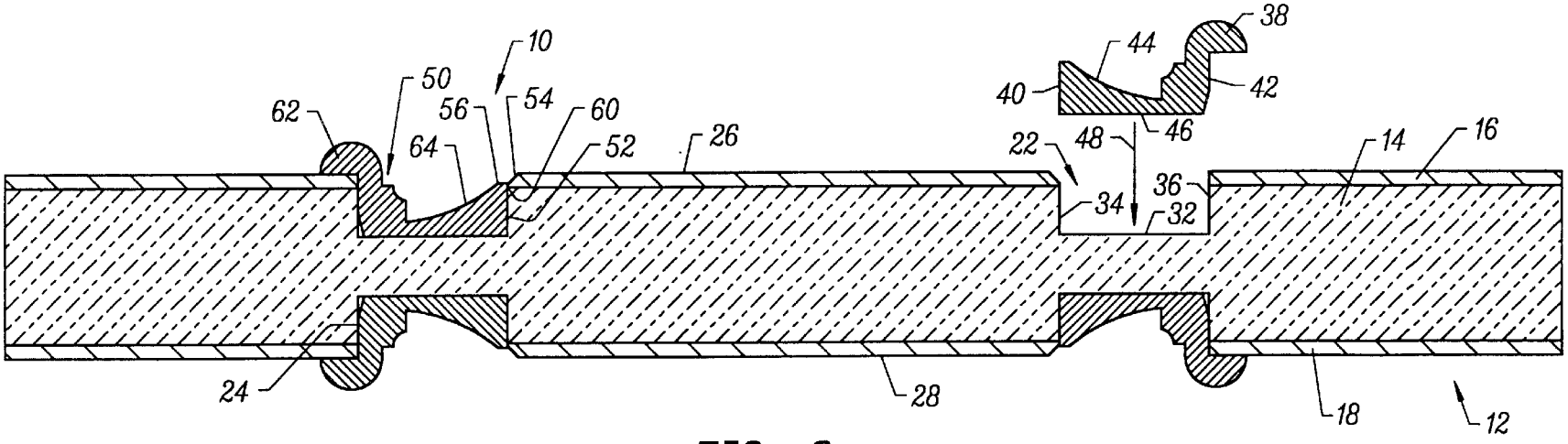
FIG. 2 is a sectional view of a simulated panel door of the present invention using an insert of a first style.

With reference to FIG. 1, it may be observed that the invention as a whole is depicted by reference character 10. The simulated panel door 10 is constructed from a conventional veneered door 12. With reference to FIG. 2, it may be observed that door 12 includes a core 14 formed of chip board, plywood, or other composite material. Core 14 is covered by veneers 16 and 18 on either side of door 12. A plurality of inserts 20 are also employed in the present invention. Inserts 20 are generally employed to present a hip raised style of door, unlike that found in the prior art raised panel door construction.

Turning to FIG. 2, it may be seen that grooves 22 and 24 are formed within door 12 by routing, a process known in the art. Groove 22 lies adjacent surface 26 of door 12 while groove 24 lies adjacent surface 28 of door 12. Surfaces 26 and 28 are flat surfaces as a result of standard manufacturing techniques. End 30 of door 12 may also be veneered, FIG. 1. Of course, end 30 extends completely around door 12 to present a uniform appearance. Groove 22, as an exemplary groove of door 10 of FIG. 2, is formed with a base surface 32 and first and second side walls 34 and 36, respectively. As hereto fore noted, groove 24 is constructed in a similar manner. Insert piece 38 is provided with a first side wall portion 40, second side wall portion 42, and a depressed lateral surface 44 therebetween. A lower surface 46 of insert 38 is intended to lie atop base surface 32 of groove 22. Directional arrow 48 indicates the direction of movement for placement of insert 38 within groove 22. With further reference to FIG. 2, it may be apparent that insert piece 50 has been placed within groove 22. A first side wall 52 extends outwardly from groove 22 and terminates at a top edge 54. A flat surface 56 lies adjacent top edge 54. In addition, veneer 16 is formed with a beveled surface 58. Lower edge 60 of beveled surface 58 meets or abuts top edge 54 of side wall of insert 56 to provide the hip raised appearance. Flange 62 of insert 50 extends over top surface 56 of veneer 16. Each of the insert pieces of plurality of insert pieces 20 fits within groove 22 according to the principal shown by insert piece 50.

Figure 3:
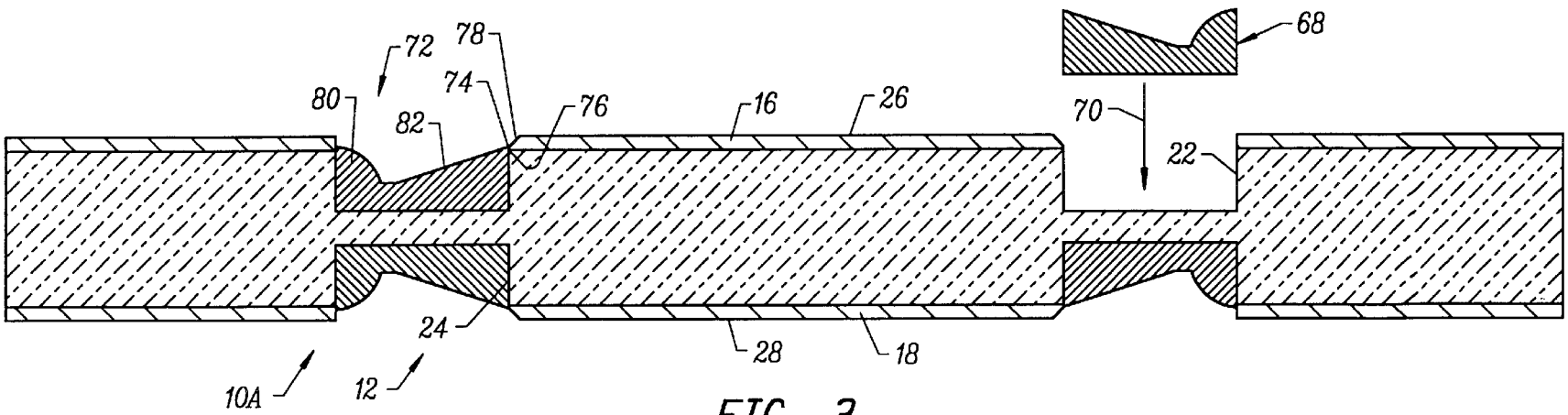
FIG. 3 is sectional view showing the simulated panel door of the present invention using an insert of a second style.

Turning to FIG. 3, a raised panel door 10A is depicted using the identical routed door 12 as is depicted in FIG. 2. Insert 68 is positioned in groove 22 according to directional arrow 70. With respect to insert piece 72, it may be observed that top edge 74 again meets the lower edge 76 of beveled surface 78 of veneer 16. However, the side wall 80 of insert 72 along depressed lateral surface 82 does not overlap top surface 26 of veneer 16. The structure of panel door 10A presents a different appearance than that of panel door 10.

In operation, a conventional veneered door 12 is routed with a rectangular groove such as groove 22, FIGS. 1, 2, and 3. A plurality of inserts 20, such as the design shown by inserts 38 and 50 or inserts 68 and 72, are placed within groove 22 such that the top edges of the inner portion of each insert lies adjacent the lower edge of a beveled surface of the veneer. For example, with respect to door 10, FIG. 2, edge 54 of side wall 52 of insert 50 exactly meets lower edge 60 of beveled surface 58 of veneer 16. With respect to FIG. 3, lower edge 76 of beveled surface 78 of veneer 26 exactly meets edge 74 of insert 72. Similar inserts are placed within groove 24 of door 12, i.e. the other side of door 12 in the style of insert shown in either FIG. 2 or in FIG. 3.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A simulated paneled door structure in a door having a flat surface veneer inward from the periphery of the door, atop a solid core comprising;

a. an endless groove formed along the flat surface and into the core of the door, said endless groove possessing an essentially uniform depth, a base surface, a first side wall, and a second side wall positioned outside said first side wall toward the periphery of the door, said first and second side walls extending outwardly from said base surface;

b. an insert having a lower surface, a first side wall, and a second side wall, each of said first and second side walls extending outwardly from said lower surface, and terminating in a top surface said lower surface of said insert lying adjacent said base surface of said groove, said first side wall of said insert lying adjacent said first side wall of said groove and said top surface extending no further outwardly than a place below said flat surface of said door, said second side wall of said insert lying adjacent said second side wall of said groove, said insert further comprising a lateral surface spanning said first and second side walls, said lateral surface include a depression therealong; and c. a beveled surface formed on the veneer of the door around said endless groove, said beveled surface including an outer edge flush with the surface the door, and an inner edge which meets said top of said first side wall of said insert.

2. The structure of claim 1 in which said second side wall of said insert includes a flange overlying said surface of said door.

3. The structure of claim 1 in which said second side wall of said insert extends no higher than said flat surface of said door.

4. The structure of claim 1 in which said insert first side wall top includes a flat surface.

5. The structure of claim 4 in which said insert first side wall top edge comprises a sharp edge which abuts said lower edge of said bevel surface of the veneer.

6. The structure of claim 4 in which said insert lateral surface further comprises a flat surface adjacent said sharp edge of said first side wall of said insert.

7. A method of constructing a simulated panel door from a door having a flat surface veneer inward from the periphery of the door, comprising;

a. forming an endless groove of uniform depth along said flat surface of said door, said groove including a base surface, a first side wall and a second side wall, said second side wall positioned outside said first side wall toward the periphery of the door, said first and second side walls extending outwardly from said base surface;

b. positioning, in said groove, an insert having a lower surface, a first side wall and a second side wall, each of said first and second side walls extending outwardly from said lower surface of said insert and terminating in a top, said lower surface of said insert lying adjacent said base surface of said groove, said first and second side walls of said insert lying adjacent said first and second side walls of said groove, respectively, said first side wall of said groove extending below the flat surface of the door;

c. forming a beveled surface on the veneer of the door around said endless groove, said beveled surface including an upper edge flush with the surface of the door, and a lower edge which meets said top of said first sidewall of said insert; and d. fastening said insert relative to said groove.

8. The method of claim 7 in which said first side wall of said insert includes a sharp edge extending no further outwardly than the flat surface of the door.

* * * * *